US005136874A

United States Patent [19]

Fisch

[11] Patent Number: 5,136,874

[45] Date of Patent: Aug. 11, 1992

[54] INDEXING CONVEYOR FOR A DIE TRANSFER SYSTEM

[75] Inventor: Alfred C. Fisch, Clarkston, Mich.

[73] Assignee: Rapindex Incorporated, Bloomfield Hills, Mich.

[21] Appl. No.: 728,270

[22] Filed: Jul. 11, 1991

Related U.S. Application Data

[63] Continuation-in-part of Ser. No. 432,076, Nov. 6, 1989, Pat. No. 5,035,134.

[51] Int. Cl.[5] ..... B21D 43/05

[52] U.S. Cl. ..... 72/405; 72/421; 198/621

[58] Field of Search ..... 72/405, 421, 422; 198/621; 414/751

[56] References Cited

U.S. PATENT DOCUMENTS

| | | | |
|---|---|---|---|
| 3,025,731 | 3/1962 | Jacobs | 72/421 |
| 3,620,381 | 11/1971 | McCaughey | 198/621 |
| 4,127,023 | 11/1978 | Jensen | 72/405 |
| 4,273,507 | 6/1981 | Herdzina | 198/621 |
| 4,741,195 | 5/1988 | Arai | 72/405 |

FOREIGN PATENT DOCUMENTS

| | | | |
|---|---|---|---|
| 2239304 | 2/1975 | France | 72/405 |
| 197335 | 8/1990 | Japan | 72/405 |

*Primary Examiner*—Daniel C. Crane

*Attorney, Agent, or Firm*—Barnes, Kisselle, Raisch, Choate, Whittemore & Hulbert

[57] ABSTRACT

A die transfer system that includes a lower die, an upper die carried for reciprocal vertical movement toward and away from the lower die to perform at least one operation on a workpiece positioned therebetween, and a conveyor for sequentially conveying workpieces between the dies. The conveyor includes a plurality of hands for gripping workpieces and spaced from each other by distances corresponding to stations of the die. The conveyor and hands are indexed in a direction through the die between the stations in synchronism with motion of the upper die. The hands are moved simultaneously in at least one direction perpendicular to the indexing direction by a camshaft that extends through the stations along an axis parallel to the indexing direction. A cam is mounted on the camshaft for rotation with the camshaft in synchronism with motion of the upper die. A follower arrangement couples the cam to the hands so that reciprocal rotation of the camshaft about its axis results in reciprocal motion of the hands in one or more directions lateral to the direction of conveyance of the workpieces through the die stations.

43 Claims, 11 Drawing Sheets

INDEXING CONVEYOR FOR A DIE TRANSFER SYSTEM

This application is a continuation-in-part of application Ser. No. 07/432,076 filed Nov. 6, 1989, now U.S. Pat. No. 5,035,134, issued Jul. 30, 1991.

The present invention is directed to die transfer systems, and more particularly to an improved conveyor for indexing workpieces through successive stations of the die assembly.

BACKGROUND AND OBJECTS OF THE INVENTION

In so-called progressive die systems, workpieces formed from strip stock remain attached to webs that extend along lateral edges of the pieces to facilitate indexing of the workpieces through successive stages of the die assembly. Although such arrangements facilitate conveyance of the workpieces through the die stations, they possess the disadvantage that the workpieces must be formed in a linear array at spaced locations along the strip stock, leading to substantial material inefficiency and waste. Furthermore, the fact that all workpieces remain interconnected during at least a major portion of the die operation can lead to difficulty and inefficiency in performing operations on the workpieces at a given station. For these reasons and others, so-called die transfer systems have been developed in which the workpieces are pre-separated and fed as individual units to the die arrangement. A die transfer system of this character permits more efficient use of the strip stock material, and also permits greater flexibility in operations that can be performed at the individual die stations. However, the conveyor arrangement for indexing individual workpieces through a die transfer system is more complex than those in typical progressive die systems, usually involving release and re-engagement with the workpieces at each of the individual die stations.

U.S. Pat. No. 5,035,134, issued Jul. 30, 1991, discloses a die transfer system that includes a fixed lower die, an upper die carried for reciprocal vertical movement toward and away from the lower die to perform operations on workpieces positioned between the dies, and a conveyor for feeding workpieces in sequence between the upper and lower dies. The upper and lower dies define a plurality of die stations, including a workpiece load station at the upstream end of the conveyor, a workpiece unload station at the downstream end of the conveyor, and at least one intermediate station for performing a desired operation on workpieces passing through the die. The conveyor comprises an endless loop conveyor that has a reach vertically positioned between the upper and lower dies. A plurality of hands are carried by the conveyor at positions spaced from each other lengthwise of the conveyor by distances corresponding to separation between the die stations, such that at least one hand is positioned to engage a workpiece at each of the stations. A drive is coupled to the conveyor for indexing the conveyor and workpieces between the upper and lower dies driven by and in synchronism with vertical motion of the upper die. The hands include facility for vertical and horizontal motion in directions perpendicular to the direction of conveyance through the die, and for rotation about an axis lateral to the die.

A general object of the present invention is to provide a die transfer system of the described character that features an improved conveyor for indexing workpieces sequentially through the individual die stations. Another and more specific object of the present invention is to provide a die transfer system in which the workpiece conveyor is of simplified and economical construction, in which motion of the workpiece hands both longitudinally and laterally of the conveyance direction takes place simultaneously at all of the stations, and/or in which synchronism of conveyor motion with descent and ascent of the upper die is improved.

SUMMARY OF THE INVENTION

A die transfer system in accordance with the present invention includes a lower die, an upper die carried for reciprocal movement toward and away from the lower die to perform at least one operation on a workpiece positioned therebetween, and a conveyor for sequentially conveying workpieces between the dies. The conveyor includes a plurality of workpiece hands spaced from each other by distances corresponding to separation between the die stations, such that at least one hand is positioned to grip a workpiece at each station. The conveyor and hands are indexed in a direction through the die between the stations in synchronism with motion of the upper die. The hands are also moved simultaneously in at least one direction perpendicular to the indexing direction by a camshaft that extends through the stations along an axis parallel to the indexing direction. A cam is mounted on the camshaft for rotation with the camshaft in synchronism with motion of the upper die. A follower arrangement couples the cam to the hands so that reciprocal rotation of the camshaft about its axis results in reciprocal motion of the hands in one or more directions lateral to the direction of conveyance of the workpieces through the die stations.

In the preferred embodiment of the invention, the follower mechanism includes an arm mounted adjacent to the cam to rotate about an axis parallel to the camshaft axis. A bar is coupled to the arm and extends through the stations parallel to the camshaft axis coupling the arm to the hands for moving the hands simultaneously as a function of rotation of the arm. The cam in the preferred embodiment of the invention takes the form of a pair of cam plates mounted at spaced positions on the camshaft, each having an arcuate cam track slot extending around the camshaft axis. A roller is affixed to the arm adjacent to each cam plate and positioned in an associated slot so as to rotate the arm as a function of motion of the cam plate.

The hands in the preferred embodiment of the invention include facility for both vertical motion perpendicular to the indexing direction for raising and lowering workpieces at the stations, and horizontal motion laterally of the indexing direction for releasing and re-engaging workpieces at the stations. A pair of parallel bars extend through the stations and engage the hands. Each bar is driven by an associated pair of cam plates at spaced positions on the camshaft, whereby a single camshaft accomplishes both vertical and horizontal lateral motion of the hands at the respective stations. The track slots in at least one pair of cam plates include portions at constant radius from the camshaft axis forming a dwell during at least a portion of the motion of the cam and follower arrangement.

The camshaft in the disclosed embodiment of the invention is rotated in synchronism with motion of the upper die by a drive arm that extends radially from the camshaft, a cam plate that depends from the upper die and a crank arm that couples the cam plate to the drive arm. Likewise, the conveyor is indexed in synchronism with motion of the upper die by a drive arm that extends radially from the drive shaft of a conveyor, a cam plate that depends from the upper die, and a crank arm that couples the cam plate to the drive arm. Rollers on the crank arms are positioned in track slots in the cam plates for rotating the drive arms and the cam and drive shafts. Most preferably, the slots in each cam plate are double-track slots having geometries such that the camshaft is rotated while the drive shaft is stationary during initial descent of the upper die, followed by rotation of the drive shaft while the cam shaft is stationary during final descent of the upper die. In the same way, the camshaft is rotated while the drive shaft is stationary during initial ascent of the upper die, followed by rotation of the drive shaft while the camshaft is stationary during final ascent of the upper die. In this way, motions at the conveyor are separated for enhanced control. Most preferably, identical conveyors are provided at the opposed sides of the die system and are driven simultaneously and in synchronism with the upper die.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

The disclosure of U.S. Pat. No. 5,035,134, assigned the assignee hereof, is incorporated herein by reference for purposes of background, and for purposes of disclosure of various assembly details in the preferred embodiment of the present invention as hereinafter described.

Figure 1:
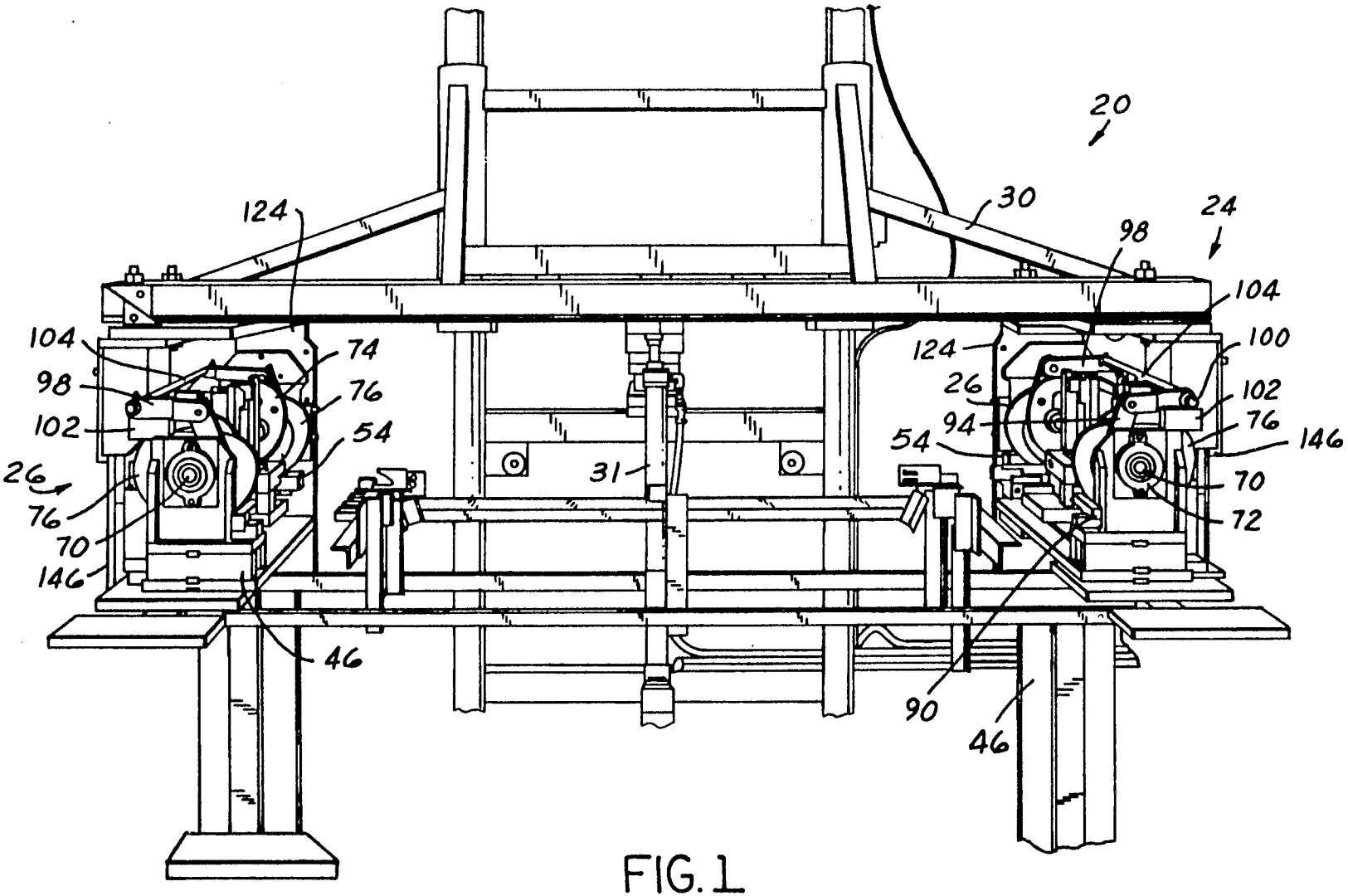
FIG. 1 is a front perspective view of a die transfer system in accordance with a presently preferred embodiment of the invention.

FIGS. 1-15 illustrate a die transfer system 20 in accordance with a presently preferred illustrative embodiment of the invention for indexing workpieces 22 through successive stations of a workpiece die. A pair of workpiece conveyors 24,26 (FIGS. 1 and 5) are positioned on laterally opposed sides of a lower die 28 (FIG. 5) and an upper die carried by an upper die support frame 30 (FIG. 1). Conveyors 24,26 cooperate with the upper and lower dies to define a workpiece load station 32 (FIG. 5) at the upstream end of the conveyors, an unload station 34 at the downstream end of the conveyors, and at least one station 36 positioned therebetween at which a desired operation is performed on each workpiece 22 upon descent of the upper die. Details of the dies, of the geometry of workpieces 22 and of the operations performed thereon by the dies are not directly germane to the present invention. Conveyors 24,26 are mirror images of each other. Conveyor 24 will be described in detail in the following discussion, it being understood that conveyor 26 is identical thereto.

Figure 2:
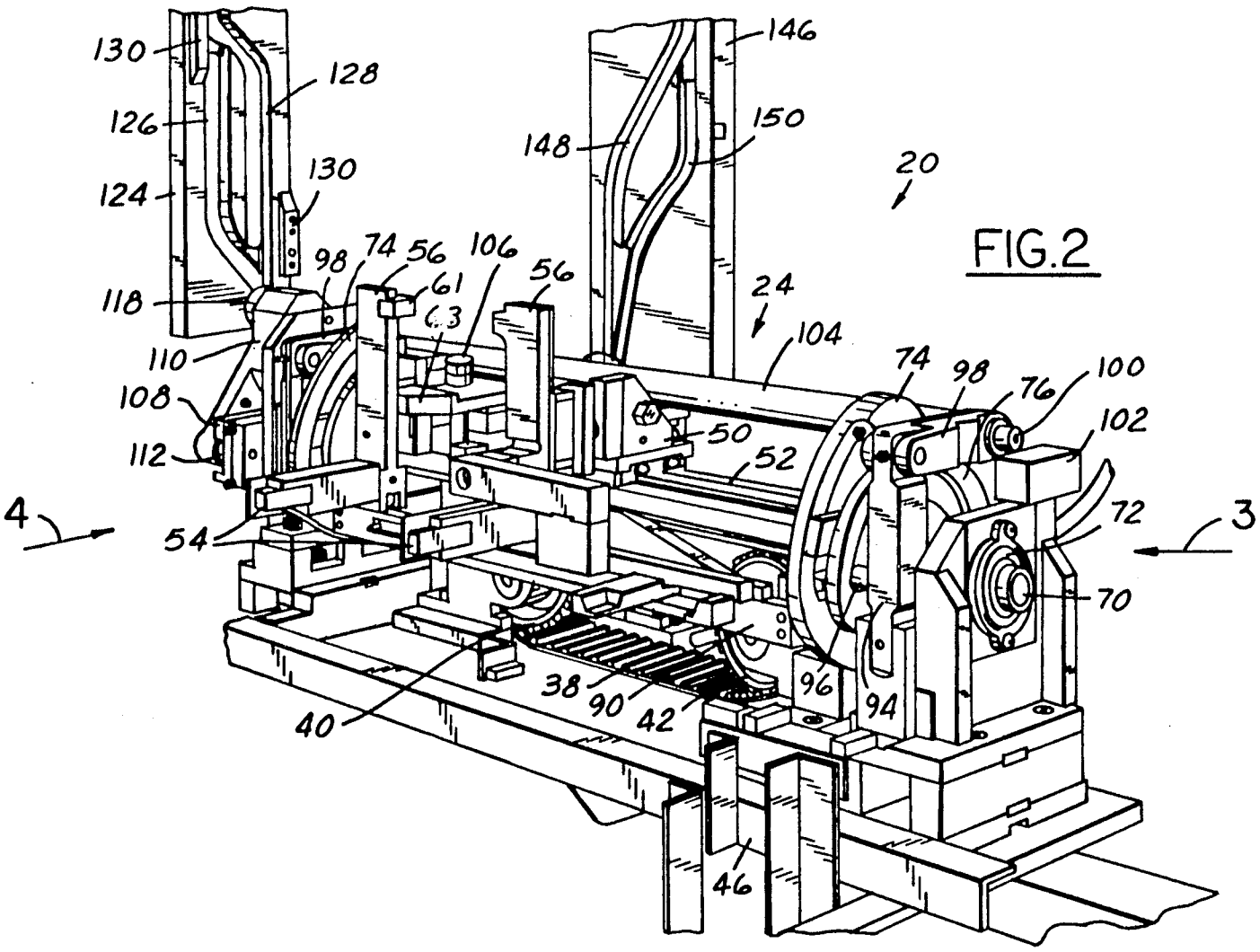
FIG. 2 is a front perspective view of one side of the conveyor illustrated in FIG. 1.
Figure 3:
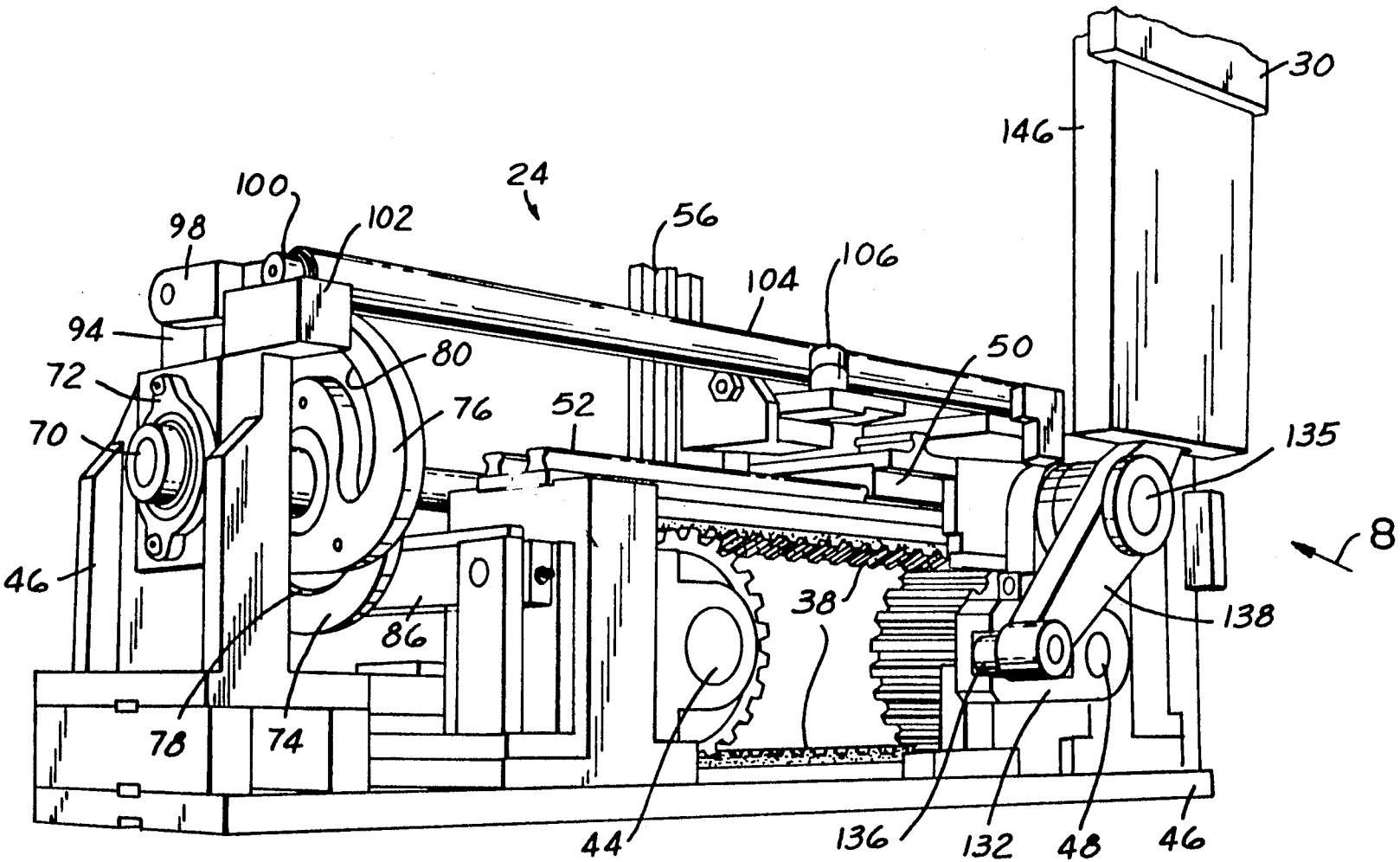
FIG. 3 is a rear perspective view of the conveyor section illustrated in FIG. 2, being taken substantially from the direction 3 in FIG. 2.
Figure 4:
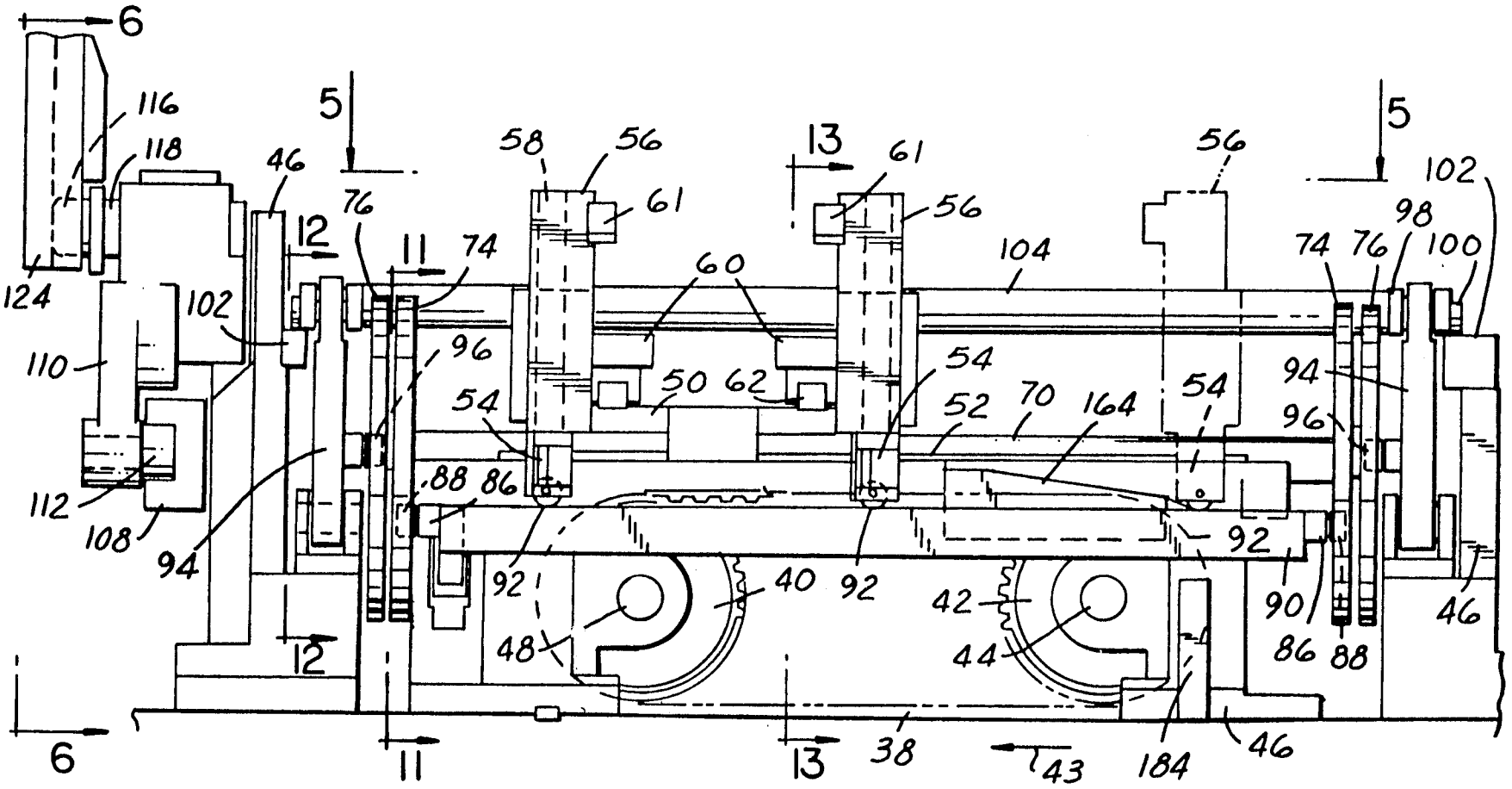
FIG. 4 is an inside elevational view of the conveyor section illustrated in FIG. 2, being taken substantially from the direction 4 in FIG. 2.

Conveyor 24 preferably takes the form of an endless-loop conveyor having a belt 38 (FIG. 2-5) trained over a pair of pulleys 40,42 spaced from each other in the direction 43 (FIGS. 4 and 5) of workpiece conveyance. Pulley 42 is freely rotatable about a shaft 44 (FIGS. 3 and 4) carried in fixed position by the conveyor support frame 46. Pulley 40 is rotatably coupled to a drive shaft 48 that extends laterally outwardly through the support frame, as best seen in FIG. 3. A support platform 50 is carried on a slide 52 above and parallel to the upper reach of conveyor belt 38. Slide 52 is mounted in fixed position on support frame 46. A pair of workpiece-engaging hands 54 are carried by platform 50. Hands 54 are spaced from each other in the direction of conveyance by a distance corresponding to separation between die stations 32,34,36 (FIG. 5) so that the hands are positioned to engage workpieces at the sequential stations. Platform 50 is coupled to belt 38 so as to reciprocate longitudinally of the die system upon reciprocation of belt 38, as will be described.

Each hand 54 is carried by a bar 56 (FIGS. 13 and 14) that is mounted for vertical motion on a slide 58. Each slide 58 is carried by a plate 60 that is coupled to platform 50 by a horizontal slide 62. Thus, each hand 54 is mounted for vertical motion between a fully lowered position illustrated in FIG. 13 and a fully raised position illustrated in FIG. 14 by motion of bar 56 along slide 58, and for horizontal motion between a fully retracted position illustrated in FIG. 13 and a fully extended position illustrated in FIG. 14 by motion of plate 60 along slide 62. In the lowered position of FIG. 13, the hands are supported by abutment of a stop 61 on each bar 56 with a ledge 63 on each plate 60 (FIGS. 1, 4–5 and 13–14), while in raised position of FIG. 14., hands 54 are supported by a bar 90 as will be described. Each hand 54 is rotatably carried by a shaft 64 that is coupled to an eccentric 66 through an opening in bar 56. To the extent thus far described (with the exception of eccentric 66 and bar 90), die transfer system 20 and conveyors 24,26 are substantially similar to those disclosed in the above-referenced co-pending application, to which reference may be made for a more detailed description of assembly, particularly with reference to the hands and the support structure.

Figure 12:
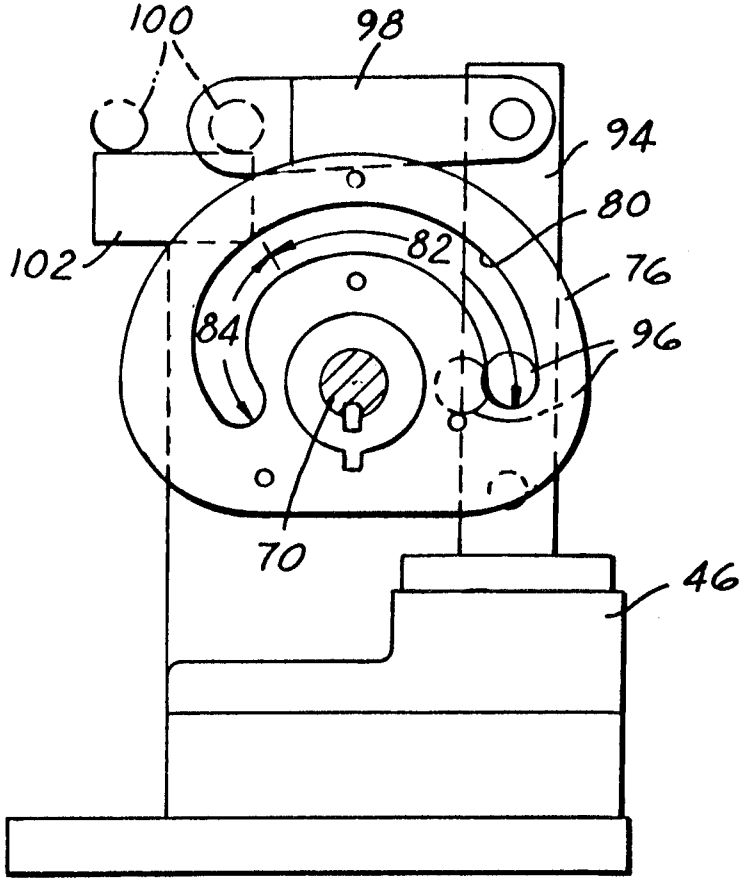
FIGS. 11 and 12 are fragmentary sectional views illustrating the cam plates and followers of the conveyor section illustrated in FIG. 4, being taken substantially along the respective lines 11—11 and 12—12 in FIG. 4.
Figure 11:
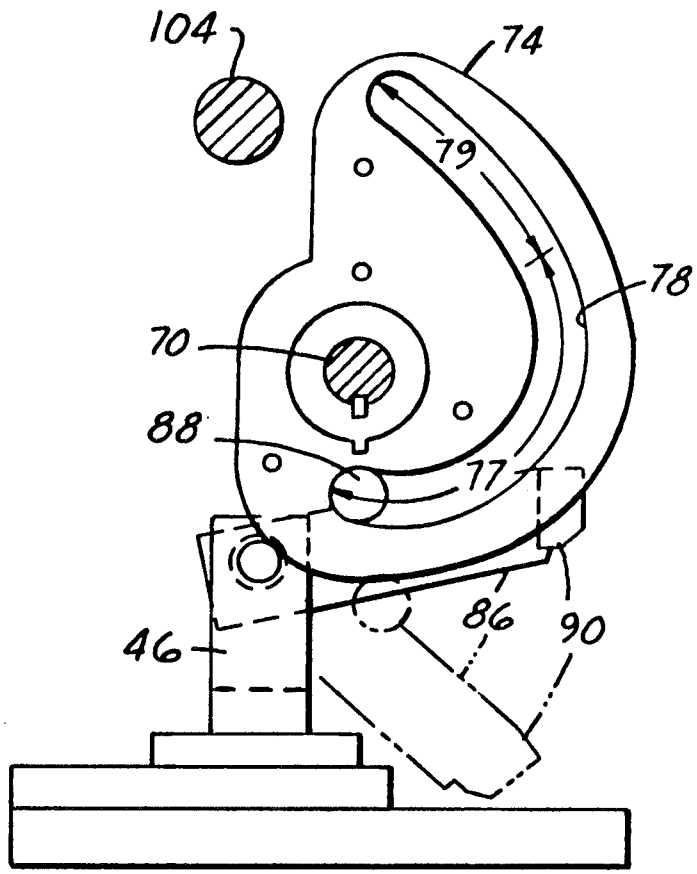

A camshaft 70 extends through conveyor 24 between spaced bearings 72 on support frame 46 for rotation about a fixed axis parallel to the direction 43 of conveyance through the die system. A pair of cam plates 74,76 are mounted at each end of camshaft 70, each cam plate 74 being adjacent to and inboard of an associated cam plate 76. Cam plates 74,76 are keyed to camshaft 70, as shown in FIGS. 11 and 12, for corotation therewith. Cam plate 74 has an arcuate cam track or slot 78 that extends around the axis of rotation of camshaft 70. Slot 78 is of progressively increasing radius from the axis of rotation of camshaft 70 starting from a position closely adjacent to camshaft 70 and ending at a position spaced from camshaft 70 approximately 180° around the camshaft axis. Likewise, cam plate 76 has an arcuate cam track or slot 80 that extends approximately 180° around the axis of camshaft 70. Slot 80 has a first portion 82 (FIG. 12) that extends over approximately 120° in which the slot is at constant radius from the axis of camshaft 70, and a second portion 84 extending over the remaining 60° in which the radius of slot 80 from the camshaft axis progressively decreases. Both cam plates 74,76 are illustrated in FIGS. 11 and 12 at their limits of counterclockwise rotation of camshaft 70, the cam plates rotating together clockwise to the opposing limits partially illustrated in phantom and then back counterclockwise to the limits shown in solid upon reciprocation of camshaft 70, as will be described.

An arm 86 (FIGS. 3 and 11) is mounted to support frame 46 to pivot about a fixed axis adjacent to and inboard of each cam plate 74. Each arm 86 carries a roller 88 (FIG. 11) positioned within slot 78 of the adjacent cam plate 74, whereby arm 86 pivots between the position shown in solid to that shown in phantom in FIG. 11 as cam plate 74 rotates clockwise. A bar 90 (FIGS. 4, 11, 13 and 14) extends between the arms 86 adjacent to the spaced ends of camshaft 70, and is thus lifted and lowered by arms 86 between the positions illustrated in solid and phantom in FIG. 11 as camshaft 70 and cam plate 76 rotate. Bar 90 is positioned to engage a roller 92 (FIGS. 4, 13 and 14) at the lower end of each hand support bar 56. Thus, in the raised positions of arms 60 and bar 90 illustrated in FIG. 14 and in solid in FIG. 11, hands 54 roll along the upper surface of bar 90 as conveyor belt 38 is indexed. As bar 90 is lowered, hands 54 drop by gravity (or can be pulled by suitable means not shown) to the fully lowered position illustrated in FIG. 13 and in phantom in FIG. 11.

In a similar manner, an arm 94 (FIGS. 1–4 and 12) is mounted on support frame 46 externally adjacent to each cam plate 76 to pivot about a fixed axis parallel to the axis of camshaft 70. A roller 96 (FIG. 12) is carried by each arm 94, and is positioned within slot 80 of the adjacent cam plate 76 so as to pivot arm 94 between the position shown in solid in FIG. 12 and the position shown in phantom upon rotation of camshaft 70 and cam plate 76 in the clockwise direction. An arm 98 is pivotally mounted at one end to the upper end of each arm 94, and is carried at the opposing end by a bearing 100 on a guide 102 fixedly mounted on support frame 46. A bar 104 (FIGS. 1–5 and 13–14) extends between the free ends of arms 98 parallel to camshaft 70. Bar 104 extends between a pair of rollers 106 (FIGS. 3, 5 and 13–14) at the back or hand-remote edge of each hand support plate 60. Rollers 106 allow the hands to translate freely along bar 104. Thus, hands 54 are retracted (FIG. 13) and extended (FIG. 14) by bar 104 as a function of rotation of camshaft 70 and cam plate 76 (FIG. 12). The positions of cam plate 76 and arms 94,98 illustrated in solid lines in FIG. 12 correspond to the fully extended position of hand 54 illustrated in FIG. 14, and the positions of rollers 96,100 illustrated in phantom in FIG. 12 correspond to the fully retracted position of hand 54 illustrated in FIG. 13.

Figure 6:
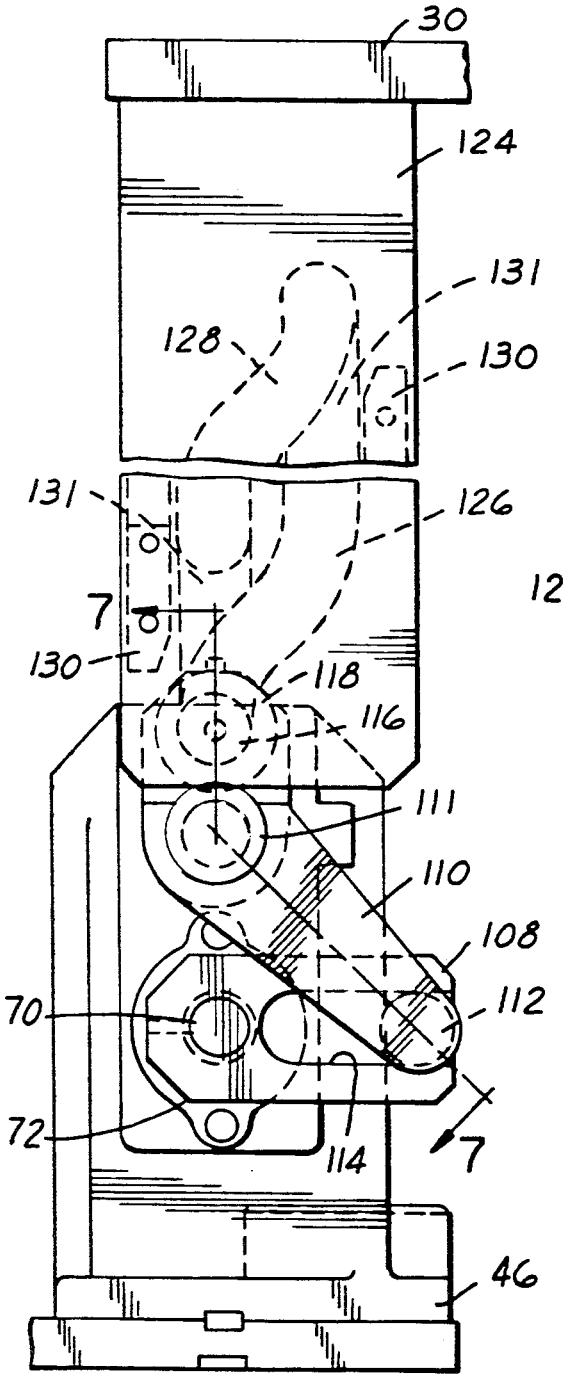
FIG. 6 is an end elevational view of the conveyor section illustrated in FIG. 4, being taken substantially from the direction 6—6 in FIG. 4.
Figure 7:
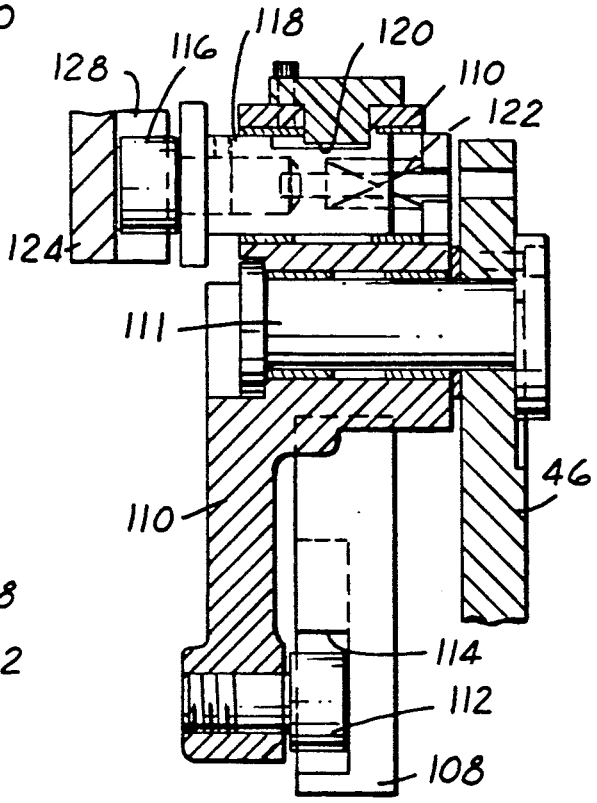
FIG. 7 is a fragmentary sectional view taken substantially along the line 7—7 in FIG. 6.
Figure 8:
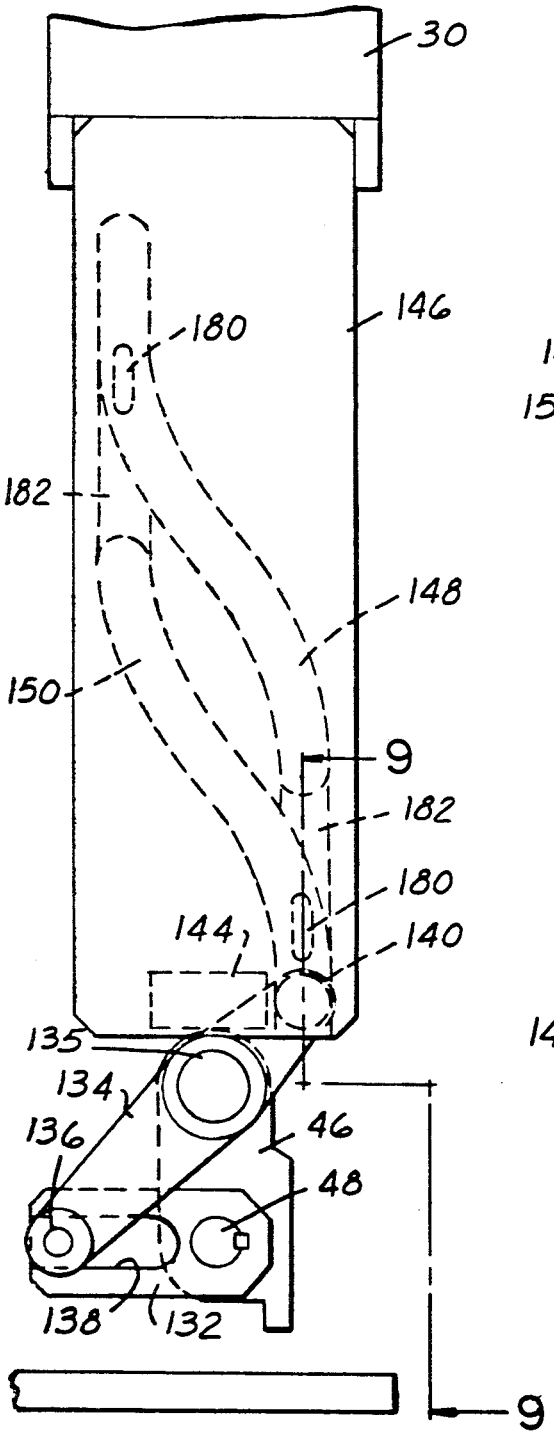
FIG. 8 is a fragmentary view in side elevation of the indexing drive arrangement, being taken substantially from the direction 8 in FIG. 3.
Figure 10:
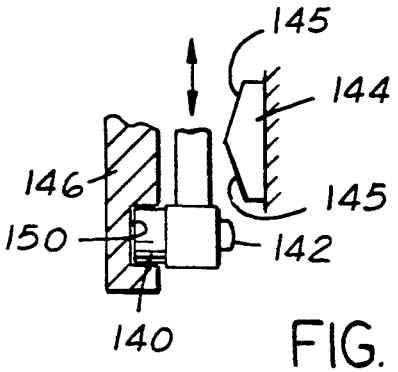
FIG. 10 is a fragmentary sectional view taken substantially along the line 10—10 in FIG. 9.
Figure 9:
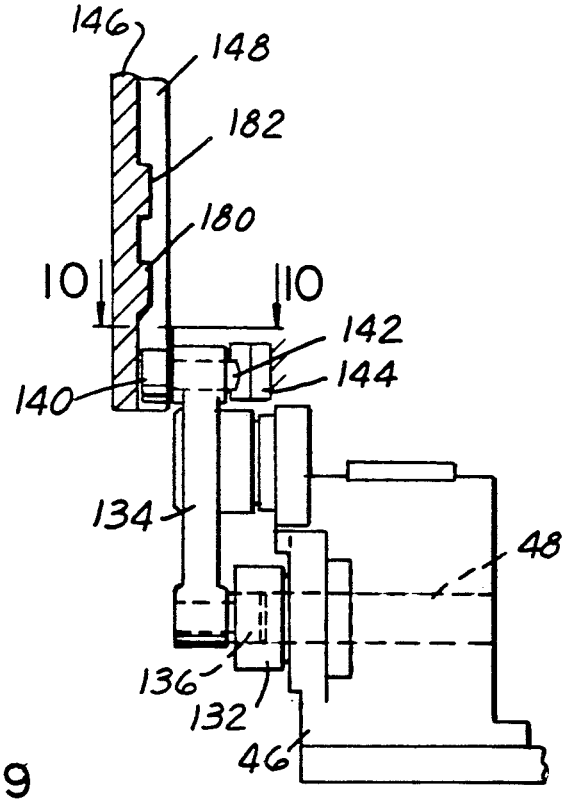
FIG. 9 is a fragmentary end elevational view of the drive arrangement illustrated in FIG. 8, being taken substantially along the line 9—9 in FIG. 8.

Camshaft 70 projects outwardly from bearing 72 on support frame 46 at the downstream end of conveyor 24, as best seen in FIGS. 6 and 7. An arm 108 (FIGS. 4, 6 and 7) is affixed to and extends radially outwardly from the projecting end of camshaft 70. A crank arm 110 is mounted to a stub shaft 111 on support frame 46 to pivot about a fixed axis above camshaft 70. One free end of crank arm 110 carries a roller 112 positioned in a radially opening slot or track 114 in arm 108. At the opposing or upper end of crank arm 110, a roller 116 is mounted on a slide 118 captured within an opening 120 (FIG. 7) on arm 110. Slide 118 and slide-mounted roller 116 are urged axially outwardly—i.e., downstream of conveyance direction 43 (FIG. 4) parallel to the camshaft axis, to the left in FIG. 7 and out of the page in FIG. 6—by a coil spring 122 (FIG. 7) captured in compression within crank arm 110. Roller 116 and slide 118 are thus movable between a fully extended position illustrated in FIG. 7, and a fully retracted position not shown. A cam plate 124 (FIGS. 1–2, 4 and 6–7) is affixed to an depends from upper die frame 30 outwardly adjacent to crank arm 110. Cam plate 124 has a pair of vertically extending cam tracks or slots 126,128 opposed to crank arm 110 on support frame 46. Cam slots 126,128 form a generally parallelogram-like parallel-track geometry, as best seen in FIG. 2, in which the cam slots coincide at their respective upper and lower ends but are laterally spaced from each other in their intermediate portions. A bar 130 is positioned adjacent to the lower end of slot 128, and adjacent to the upper end of slot 126, for engagement with slide 118 (FIG. 7) for urging roller 116 out of engagement with the cam track as the upper die frame approaches the lower and upper limits of travel.

Referring now to FIGS. 3 and 8–10, drive shaft 48 projects laterally outwardly from support frame 46. An arm 132 is affixed to the outer end of drive shaft 48, and projects radially therefrom. A crank arm 134 is mounted to a stub shaft 135 on support 46 to pivot about a fixed axis above drive shaft 48. A roller 136 (which is eccentrically adjustable for adjustment of transfer pitch) is carried at one free end of crank arm 34, and is disposed in a radially opening track or slot 138 on arm 132. At the opposing or upper end of crank arm 134, a roller 140 is freely rotatable and axially slidable on a shaft 142 that is journaled in and extends through arm 134 along an axis parallel to drive shaft 48. A cam surface plate 144 is carried by support frame 46 adjacent to the upper end of crank arm 134, and has opposed sloping surfaces 145, best seen in FIG. 10, for opposed engagement with the inner end of shaft 142 as crank arm 134 pivots therepast, and for thereby urging roller 140 outwardly. A cam plate 146 (FIGS. 1-2, 3 and 8-10) is affixed to and depends from upper die support frame 30 outwardly adjacent to the upper end of crank arm 134. A pair of tracks or slots 148,150 vertically extend along the inside surface of cam plate 146 opposed to crank arm 134. Slots 148,150 form a generally parallelogram-like parallel-track geometry merging with each other at their upper and lower ends at the lower and upper limits of upper die travel, and being laterally spaced from each other in their intermediate portions. Roller 140 on the upper end of crank arm 134 is positioned to travel along tracks 148,150 as the upper die descends and ascends respectively.

Figure 5:
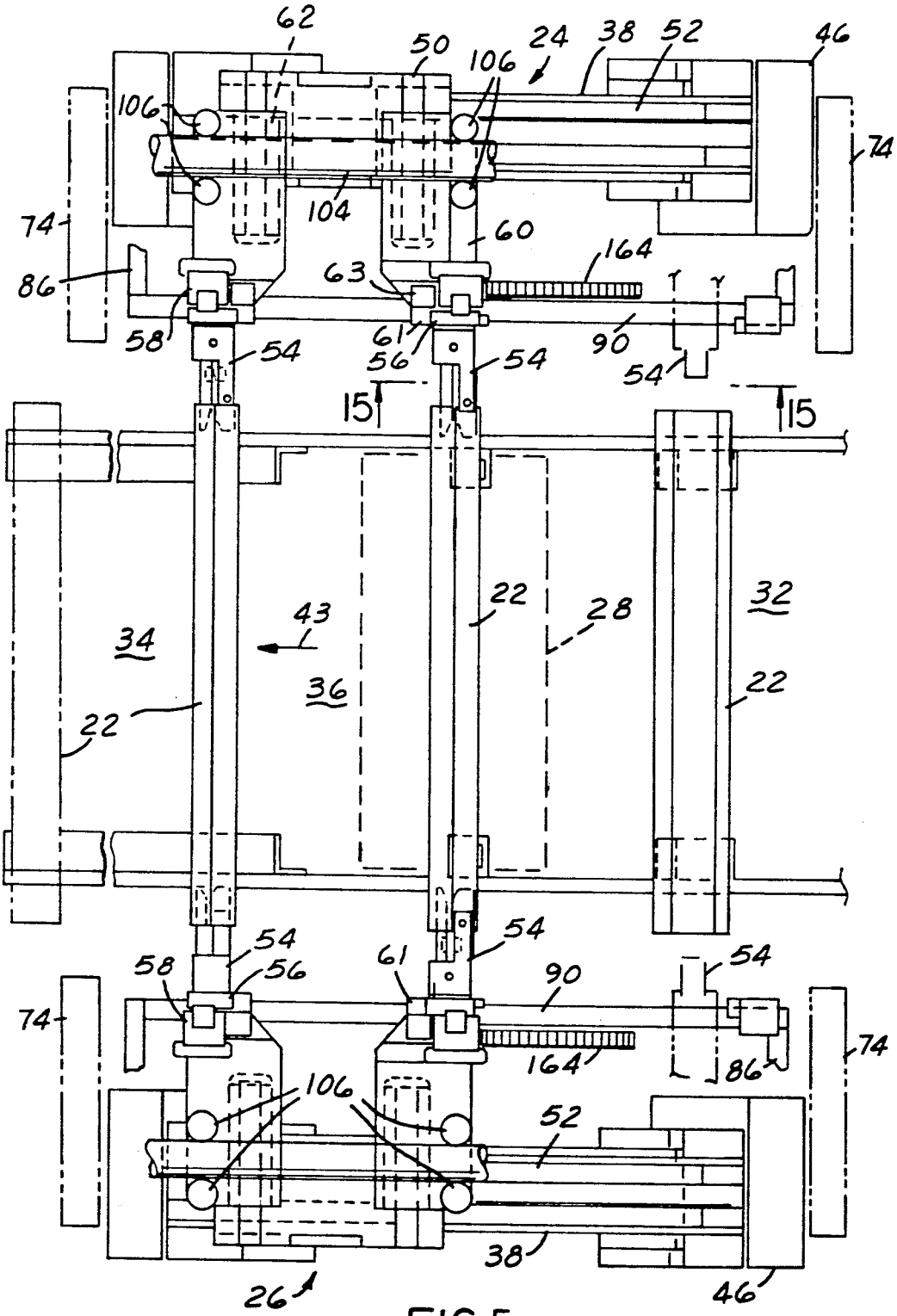
FIG. 5 is a top plan view of the transfer system, being taken substantially from the direction 5—5 in FIG. 4.
Figure 14:
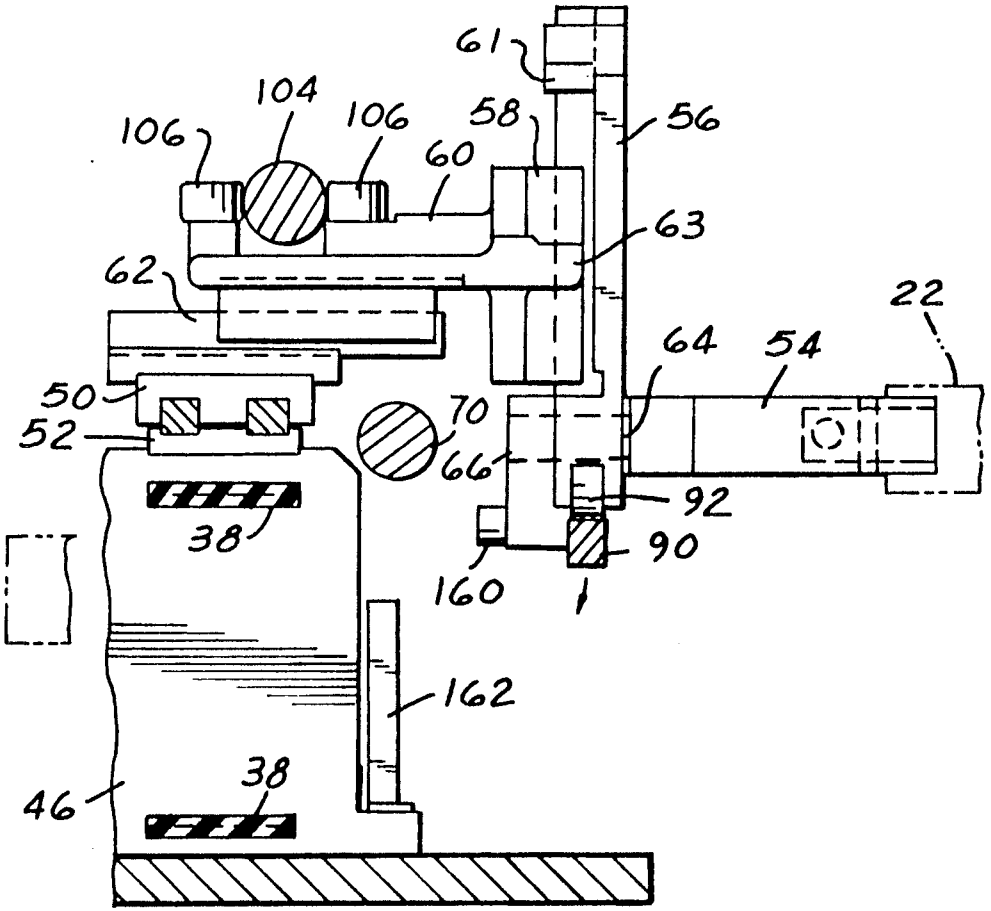
FIG. 14 is a view similar to that of FIG. 13 showing a conveyor hand in the fully raised and extended position.

With the upper die and die frame 30 in the fully raised or top dead center (FIG. 16) position, the conveyor components are in the positions illustrated in FIGS. 2-4, 6-10 and 14, and in solid lines in FIGS. 5, 11 and 12. That is, conveyor belt 38, hand platform 50 and hands 54 are in their fully forward or downstream positions (FIGS. 2-5), and the hands are fully raised and extended (FIGS. 11-12 and 14). As upper die frame 30 begins initial descent by operation of ram 31 (FIG. 1) or other suitable means), roller 116 in slot 126 of cam plate 124 starts to rotate crank arm 110, arm 108 and camshaft 70. Arm 108, camshaft 70 and cam plates 74,76 are thereby rotated clockwise as viewed in FIGS. 6 and 11-12 (counterclockwise in FIGS. 2-3) by crank arm 110 as roller 116 follows slot 126 to the right as oriented in FIG. 6 (to the left in FIG. 2). As cam plate 74 begins rotation, arms 86 and bar 90 are lowered toward the position illustrated in phantom in FIG. 11, lowering hands 54 toward the position illustrated in FIG. 13. Hands 54 reach their fully lowered positions (FIG. 3), in which stops 61 rest on shoulders 63, when cam plate 74 has rotated through the initial position 77 (FIG. 11) of rotation, which corresponds to portion 82 (FIG. 12) of cam plate 76—i.e., approximately 120°. The remaining portion 79 (FIG. 11) of rotation of cam plate 74 (corresponding to portion 84 for cam plate 76) lowers bar 90 out of the way, but does not move the hands. Workpieces are thereby positioned and released at work station 36 and unload station 34 (FIG. 5).

Figure 16:
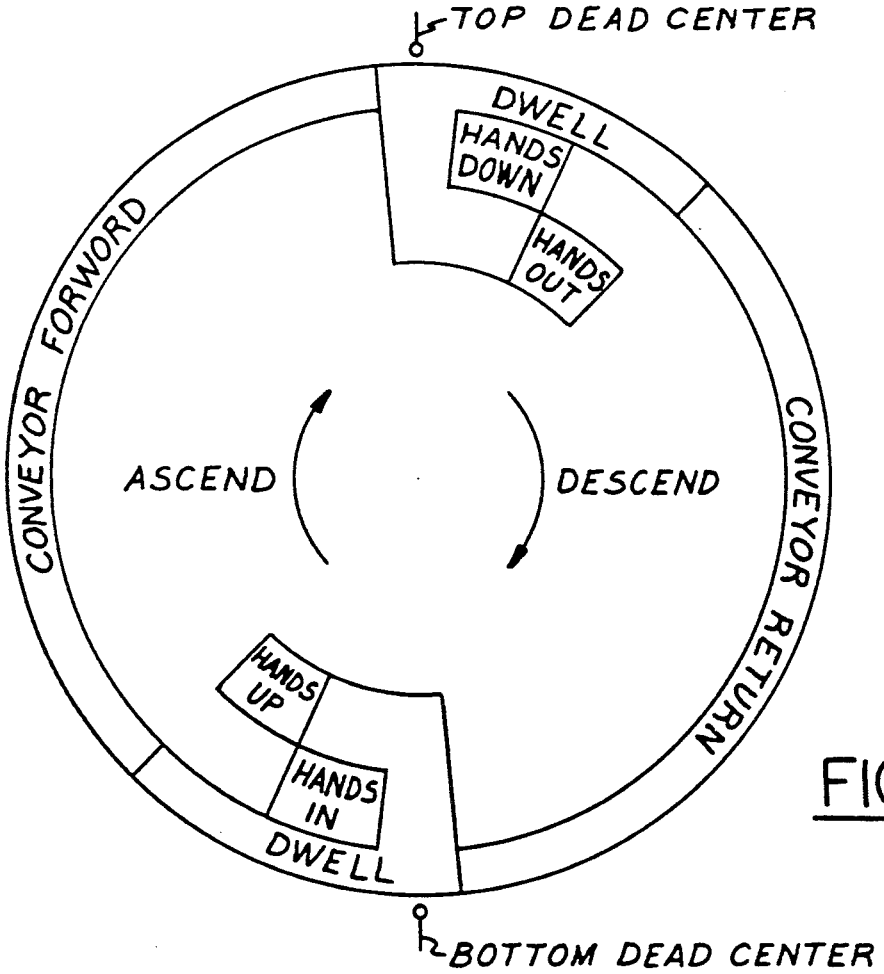
FIG. 16 is a timing diagram that illustrates motions and dwells as the upper die descends and ascends.

During initial rotation of camshaft 70, rollers 96 on arms 94 are in the dwell portion 82 of slot 80 on cam plate 76, so that hands 54 remain in the fully extended position illustrated in FIG. 14 as the hands are lowered by bar 90. Only during the latter portion of rotation of camshaft 70 (180° of total rotation), when rollers 96 are in the portion 84 of slot 80 of decreasing radius, do arms 94,98 and bar 100 retract hands 54 in the lateral direction toward the position illustrated in FIG. 13. Such lowering and retraction of hands 54 take place as roller 116 travels the initial portion of slot 126 and pivots crank arm 110 clockwise as viewed in FIG. 6. Thereafter, where track 126 is strictly vertical, crank arm 110 and camshaft 70 dwell in the fully lowered and retracted positions of the hands. Thus, as shown in FIG. 16, lowering and retraction of the hands take place during separate portions of cam shaft rotation, each motion being in a dwell while the other takes place. As roller 116 approaches the upper end of slot 126, slide 118 engages bar 130, which cams slide 118 (and roller 116) out of slot 126 against spring 122 sufficiently to clear the ledge 131 (FIG. 6) that separates the upper end of slot 126 from the upper end of slot 128. Bar 130 has sufficient length to hold the slide until the roller clears the ledge, after which spring 122 snaps slide 118 outwardly and roller 116 into the upper end of slot 128.

In the meantime, initial descent of upper die frame 30 and cam plate 146 (FIGS. 2, 3 and 8-10) does not cause rotation of drive shaft 48 and reciprocation of conveyor belt 38 because roller 140 traverses a vertical dwell portion of cam plate track slot 148. Thus, FIG. 16 shows the conveyors being in dwell as the hands are moved. As plate 146 descends, roller 140 on crank arm 134 engages a button 180 (FIGS. 8 and 9) at the lower end of track 150, which pushes roller 140 and shaft 142 into the crank arm sufficiently to clear the ledge 182 that separates the lower end of track 148 from track 150, but not sufficiently to clear the track. Roller 140 thereby enters track 148. When roller 140 enters the angulated portion of track slot 148 during the upper intermediate portion of the descent of upper die frame 30, the roller begins to pivot crank arm 134 counterclockwise as viewed in FIGS. 3 and 8. Such counterclockwise rotation of crank arm 134 rotates drive shaft 48 180° counterclockwise (in the orientations of FIGS. 3 and 8) driving belt 38 counterclockwise (in the orientation of FIG. 3) and returning hands 54 to the rearward or upstream positions illustrated in phantom in FIG. 5. Rotation of crank arm 134 also brings the end of shaft 142 into engagement with a cam surface 145 of plate 144 (FIGS. 8-10), which pushes roller 140 back into track 148.

Figure 13:
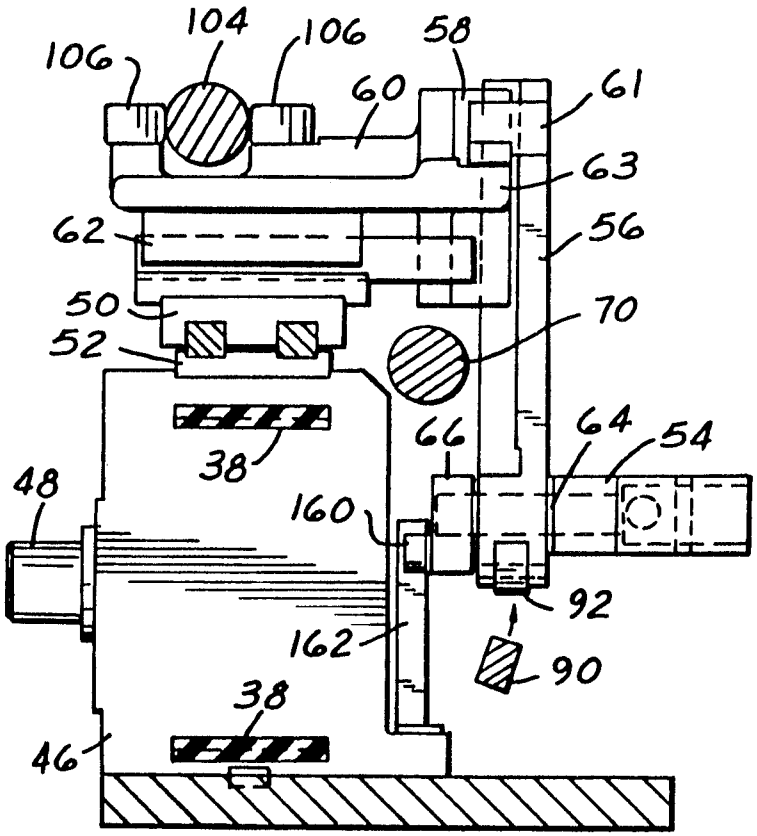
FIG. 13 is a sectional view showing a conveyor hand in the fully lowered and retracted position, being taken substantially along the line 13—13 in FIG. 4.

By the time roller 140 enters the angulated portion of cam plate track 148 so as to drive the conveyor, hands 54 have assumed the fully lowered and retracted positions illustrated in FIG. 13. The hands are thus in the fully lowered, retracted, and rearwardly indexed positions when the upper die and die frame enter the final portion of their descent, during which the upper die performs desired operations on the workpiece at the station 28 (FIG. 5). As roller enters the upper end of track slot 148, in which motion dwells (FIG. 16) as the die frame approaches the fully lowered or bottom dead center position, roller 140 encounters another button 180 that pushes the roller and shaft 142 partly but not completely out of the track slot. Upper die frame 30 is thus in the fully lowered or descended position illustrated in FIG. 1.

As the upper die and die frame 30 thereafter begin ascent, roller 116 on camshaft crank arm 110 (FIGS. 6-7) immediately enters the angulated portion of track 128 on cam plate 124. (Ledge 131 prevents entry into slot 126). Crank arm 110 is thereby rotated counterclockwise during the initial portion of upper die ascent toward and to the position illustrated in FIG. 6. Arm 108 and camshaft 70 are thereby rotated 180° counterclockwise to the positions illustrated in FIG. 6, rotating cam plates 74,76 to the positions illustrated in solid lines in FIGS. 11 and 12. During the initial portion of such cam plate rotation, rollers 96 in portions 84 of tracks 80 on cam plates 76 move bar 104 from the fully retracted position of FIG. 13 toward and to the fully extended position of FIG. 14 in which hand 54, now in the upstream positions illustrated in phantom in FIG. 5, extend to grip the workpieces at load station 32 and workstation 36. Then rollers 88 on arms 86 begin to raise arms 86 and bar 90 from the position illustrated in phantom in FIG. 11 and in FIG. 13. Continued ascent of upper die frame 30 brings roller 116 into the vertical portion of track 128, by which time hands 54 are in the fully raised and extended position of FIG. 14, and thereafter dwell in this position holding the workpieces as the upper die frame ascends further. At the lower end of slot 128, bar 130 cams slide 118 and roller 116 over ledge 131 and into slot 126 preparatory to the next cycle.

During initial ascent of the upper die frame, roller 140 (FIGS. 8-10) is in the vertical reach of track 150 on cam plate 146, so that conveyor drive shaft 48 and conveyor belt 38 dwell in the rearward or upstream positions. (Roller 140 is prevented from entering slot 148 by button 180 at the upper end of slot 148, which enables the roller to skip the ledge 182 and enter slot 150.) After camshaft crank arm 110 enters the dwell position illustrated in FIG. 6, drive shaft crank arm roller 140 enters the angulated portion of track 150, so that further ascent of the upper die frame rotates crank arm 134, arm 132 and drive shaft 48 clockwise in the orientation of FIGS. 3 and 8 to the positions of these components illustrated in these figures. Such rotation of drive shaft 48 moves conveyor belt 38 clockwise in FIG. 3, thereby moving platform 50, hands 54 and the workpieces held by the hands in forward direction 43 of conveyor travel from the position illustrated in phantom to the positions illustrated in solid in FIG. 5. At the latter position, workpieces 22 are positioned above workstation 36 and unload station 34, preparatory to deposition of the workpieces at these stations upon the next descent of the upper die frame. Rotation of crank arm 134 also brings shaft 142 into engagement with plate 144 so as to push roller 140 into slot 150.

Figure 15:
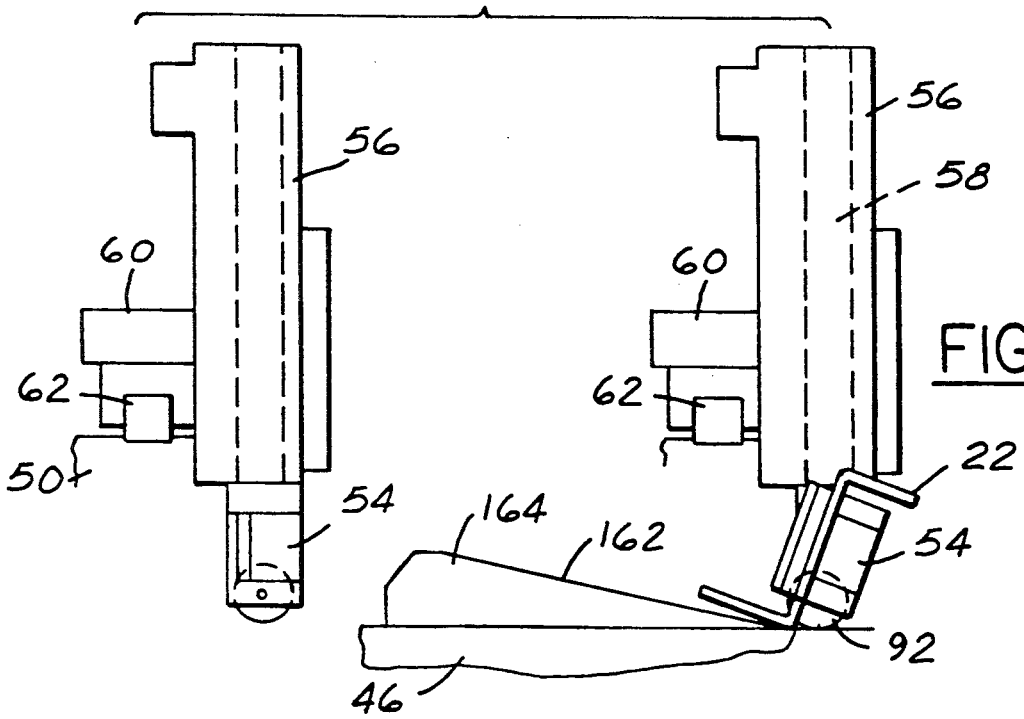
FIG. 15 is a fragmentary sectional view taken substantially in the direction 15—15 in FIG. 5 showing the mechanism for rotating the hands.
Figure 17:
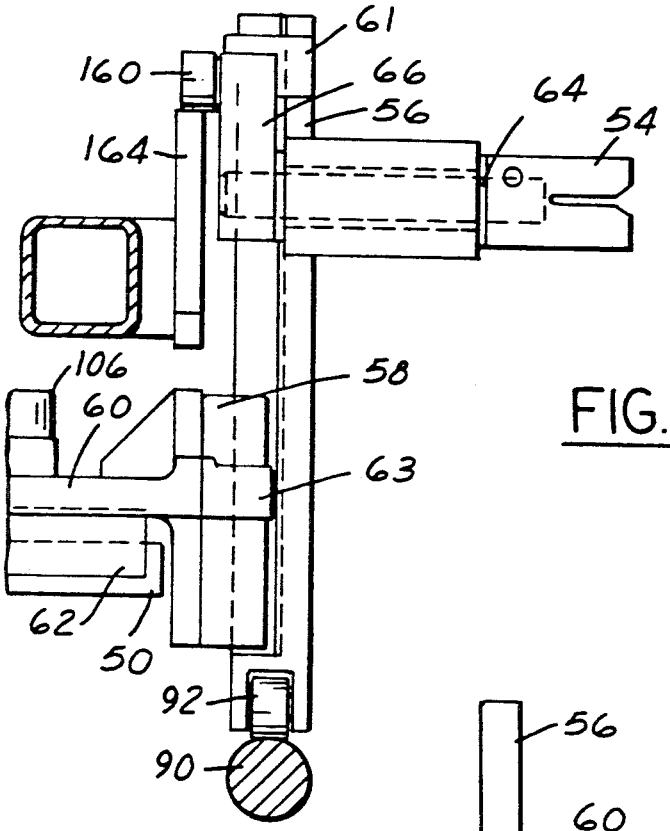
FIG. 17 is a fragmentary view similar to that of FIG. 14 but showing a modified embodiment of the invention.

FIGS. 5, 13 and 15 illustrated a feature whereby hands 54 on the opposing conveyors 24,26 are rotated during ascent of the upper die frame as the upstream hands are indexed from load station 32 to workstation 36. A roller 160 is carried by eccentric 66 offset from the axis of shaft 64, as best seen in FIG. 13. As the hands move in the forward direction, roller 160 is brought into engagement with the ramping surface 162 of a cam 164 carried by frame 46. As the hands move rearwardly during upper die descent, roller 160 on each upstream hand engages a block 184 (FIG. 4), which rotates the hand to its original orientation preparatory to engaging the next part. FIG. 17 illustrates a modification to the hand-rotation arrangement in which the cam plate 162 is carried by frame 46 above hand plate 60. This helps eliminate the need for lost travel of bar 90.

Figure 18:
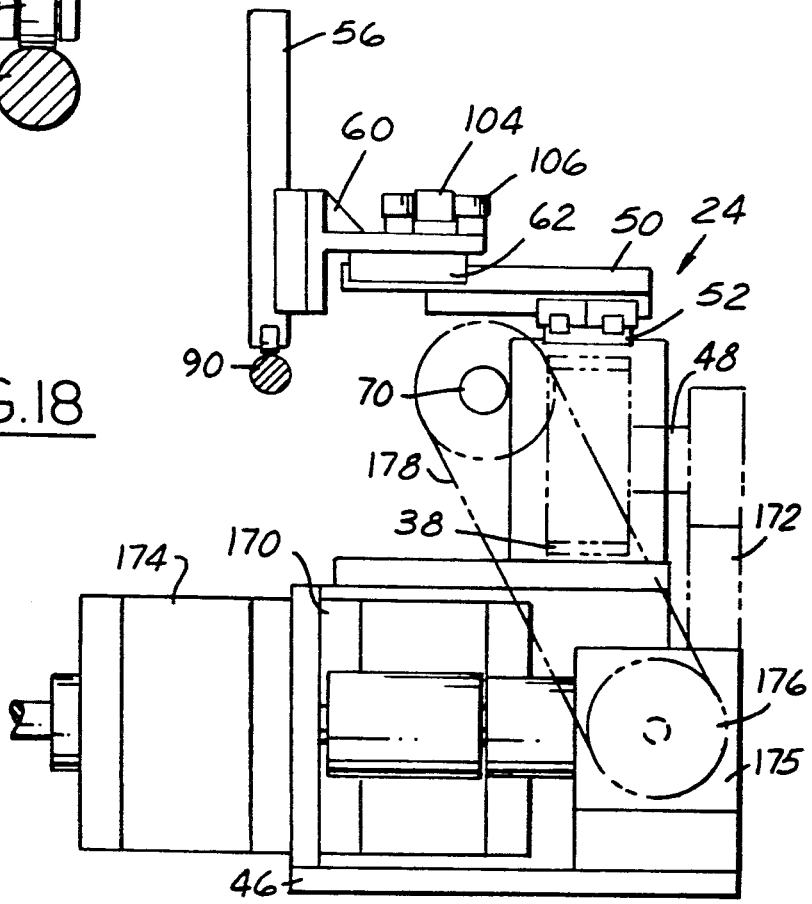
FIG. 18 is a schematic diagram of a modified embodiment of the invention that features a servo motor for driving the conveyor.
Figure 18:
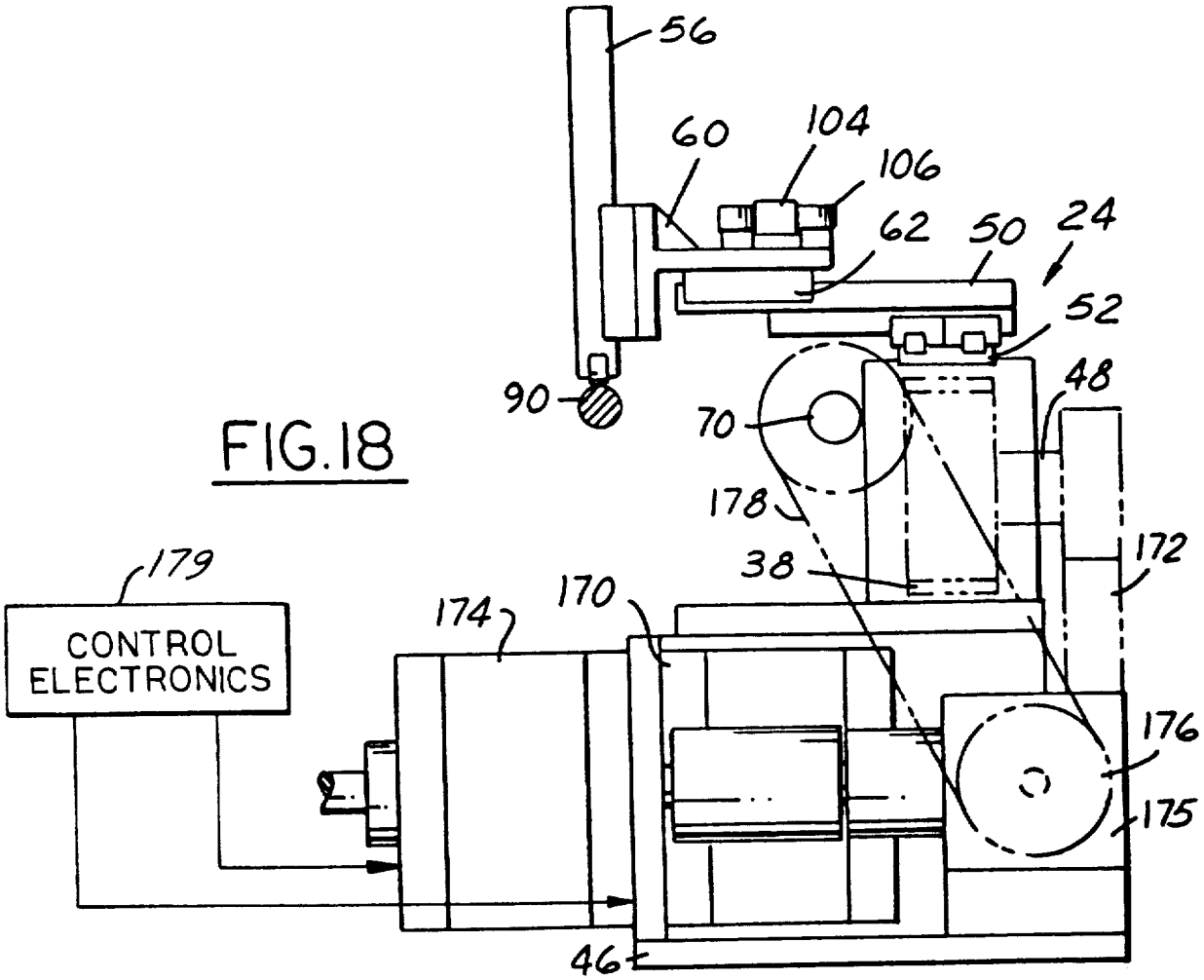

FIG. 18 illustrates a modification to the preferred embodiment of the invention (FIGS. 1-16) in which drive shaft 48 of each conveyor 24,26 is driven by a servo motor 170, rather than by cam plates 146 depending from the upper die frame. Each drive shaft 48 is coupled to servo motor 170 by a pair of pulleys and a drive belt 172. Servo motor 170 is mounted on support frame 46 beneath the level of conveyor belts 38. FIG. 18 likewise illustrates a modification, which may be used conjointly with or separately from servo motor 170, where camshafts 70 of both conveyor sections 24,26 are driven by a servo motor 174, a right-angle gear box 175, a drive pulley 176 and a drive belt 178, rather than by the cam plates 124 depending from the upper die frame 30. Servo motor 170 and/or 174 is controlled by suitable electronics 179 in synchronism with motion of the upper die and frame. Use of servo motors allows for more convenient timing adjustment and latitude.

I claim:

1. A die transfer system that includes lower die means, upper die means carried for reciprocal movement toward and away from said lower die means to perform at least one operation on a workpiece positioned therebetween, and means for sequentially conveying workpieces between said die means comprising:

a plurality of hands for engaging workpieces and being spaced from each other by distances corresponding to stations of said die means, means for indexing said hands in a direction through said die means between said stations in synchronism with motion of said upper die means, and means for moving said hands simultaneously in at least one direction perpendicular to said indexing direction comprising a camshaft extending through said stations and having an axis parallel to said indexing direction, means for rotating said camshaft in synchronism with motion of said upper die means, cam means mounted in said camshaft for rotation therewith, said follower means comprising an arm mounted adjacent to said cam means to rotate about an axis parallel to said camshaft axis, and a bar coupled to said arm and extending through said stations parallel to said camshaft axis coupling said arm to said plurality of hands for moving said hands simultaneously as a function of rotation of said arm.

2. The system set forth in claim 1 wherein said cam means comprises a cam plate having a cam slot extending around said camshaft axis, and wherein said follower means comprises a roller affixed to said arm and positioned in said slot.

3. The system set forth in claim 2 wherein said cam means comprises first and second cam plates mounted at spaced positions on said camshaft, and first and second arms mounted adjacent to said plates and coupled to said bar.

4. The system set forth in claim 1 wherein each of said hands includes means mounting said hands for vertical motion perpendicular to said indexing direction for raising and lowering workpieces at said stations, and wherein said bar extends through said stations beneath said hands, rotation of said arm raising said bar to engage and raise said hands and lowering said bar to lower and release said hands.

5. The system set forth in claim 4 wherein said hands include bearing means positioned to be engaged by said bar for translation along said bar.

6. The system set forth in claim 1 wherein each of said hands includes means mounting said hands for horizontal motion perpendicular to said indexing direction for releasing and engaging workpieces at said stations, and wherein said bar extends through said stations such that rotation of said arm moves said bar to extend and retract said hands simultaneously.

7. The system set forth in claim 6 wherein said hands include bearing means positioned to be engaged by said bar for translation along said bar.

8. The system set forth in claim 1 wherein each of said hands includes first means mounting said hands on said conveying means for vertical motion perpendicular to said indexing direction for raising and lowering workpieces at said stations, and second means mounting said hands on said conveying means for horizontal motion perpendicular to said indexing direction for releasing and engaging workpieces at said stations; and wherein said follower means comprises a first bar extending through said stations beneath said first means and a first arm coupled to said cam means for raising and lowering said first bar into and out of engagement with said first means as a function of rotation of said camshaft, and a second bar extending through said stations in engagement with said second means and a second arm coupled to said cam means for extending and retracting said hands simultaneously as a function of rotation of said camshaft.

9. The system set forth in claim 8 wherein said cam means comprises first and second cams mounted on said camshaft, and first and second follower means coupling said first and second cams to said first and second arms respectively.

10. The system set forth in claim 9 wherein each said cam comprises a cam plate having an arcuate cam slot extending around said camshaft axis, and wherein each said follower means comprises a roller affixed to the associated arm and positioned in the associated slot.

11. The system set forth in claim 10 wherein at least one of said cam slots includes a portion at constant radius from said camshaft axis forming a dwell during at least a portion of the motion of the other said cam and follower.

12. The system set forth in claim 1 wherein said means for rotating said camshaft in synchronism with motion of said upper die means comprises means affixed to said upper die means and operatively coupled to said camshaft for rotating said camshaft in opposite directions during descent and ascent of said upper die means.

13. The system set forth in claim 12 wherein said means for rotating said camshaft comprises a drive arm extending radially from said camshaft, a cam plate depending from said upper die means, and a crank arm coupling said cam plate to said drive arm.

14. The system set forth in claim 1 wherein said means for indexing said hands in synchronism with motion of said upper die means comprises a conveyor having said hands mounted thereon, a drive shaft coupled to said conveyor for rotation about an axis perpendicular to said camshaft axis, and means operatively coupled to said drive shaft for rotating said drive shaft in opposite directions during descent and ascent of said upper die means.

15. The system set forth in claim 1 wherein said means for indexing said hands in synchronism with motion of said upper die means comprises a conveyor having said hands mounted thereon, a drive shaft coupled to said conveyor for rotation about an axis perpendicular to said camshaft axis, and means operatively coupled to said drive shaft for rotating said drive shaft in synchronism with motion of said upper die means.

16. The system set forth in claim 15 wherein said means for rotating said drive shaft and said camshaft comprise at least one servo motor.

17. The system set forth in claim 1 wherein said means for rotating said camshaft comprises a servo motor.

18. The system set forth in claim 1 further comprising means for rotating said at least one of said hands about an axis perpendicular to said indexing direction.

19. A die transfer system that includes lower die means, upper die means mounted for reciprocal vertical movement toward and away from said lower die means, said upper and lower die means defining die stations spaced from each other lengthwise of said die means including workpiece load and unload stations at opposed ends of said die means and at least one work station between said load and unload stations at which said upper and lower die means include means for performing a selected operation on a workpiece positioned therebetween upon closure of said die means, and means for conveying a sequence of workpieces in turn from said load station through said work station to said unload station comprising, a pair of conveyors positioned on laterally opposed sides of said lower die means, each of said conveyors extending lengthwise of said die means through said stations coplanar with each other, a plurality of hands carried in opposed pairs on said conveyors, each of said hands including means for engaging and locating the periphery of a workpiece, said hands being spaced from each other lengthwise of said conveyors by distances corresponding to separation between said stations such that at least one opposed pair of said hands is positioned to engage a workpiece at each said station, means mounting each said hand to the associated conveyor for horizontal motion laterally inwardly of said die means, first means for engaging laterally opposed hands on said conveyors at said load station to cause said hands to engage and locate a workpiece positioned therebetween, said first means comprising means at said load station for moving laterally opposed pairs of said hands laterally inwardly simultaneously to engage lateral edges of a workpiece positioned therebetween, second means for engaging laterally opposed hands on said conveyors at said unload station to cause said hands to release a workpiece positioned therebetween, said second means comprising means at said unload station for moving laterally opposed pairs of hands laterally outwardly simultaneously to release lateral edges of a workpiece positioned therebetween, and means for indexing said conveyors and workpieces engaged and located by said hands in a direction lengthwise of said die means through said stations by incremental distances corresponding to separation between said stations, said first and second means comprising a pair of camshafts positioned on laterally opposed sides of said lower die means and having axes of rotation parallel to said indexing direction, means for rotating said camshafts substantially simultaneously in synchronism with motion of said upper die means, cam means mounted on each said camshaft for rotation therewith, and follower means coupling each said cam means to hands on the associated conveyor so as to move said hands at said load and unload stations laterally inwardly and outwardly substantially simultaneously.

20. The system set forth in claim 19 wherein said means for rotating said camshaft in synchronism with motion of said upper die means comprises means affixed to said upper die means and operatively coupled to said camshaft for rotating said camshaft in opposite direction during descent and ascent of said upper die means.

21. The system set forth in claim 20 wherein said means for indexing said conveyors comprises a drive shaft coupled to each said conveyor for rotation about an axis perpendicular to said camshafts, and means operatively coupled to said drive shafts for rotating said drive shafts in opposite directions during descent and ascent of said upper die means.

22. The system set forth in claim 21 wherein said means affixed to said upper die means comprises first and second cam means, and first and second follower means operatively coupling said first and second cam means to said camshafts and said drive shafts respectively.

23. The system set forth in claim 19 wherein said means for rotating said camshafts comprises a servo motor.

24. A die transfer system that includes lower die means, upper die means mounted for reciprocal vertical movement toward and away from said lower die means, said upper and lower die means defining die stations spaced from each other lengthwise of said die means including workpiece load and unload stations at opposed ends of said die means and at least one work station between said load and unload stations at which said upper and lower die means include means for performing a selected operation on a workpiece positioned therebetween upon closure of said die means, and means for conveying a sequence of workpieces in turn from said load station through said work station to said unload station comprising, a pair of conveyors positioned on laterally opposed sides of said lower die means, each of said conveyors extending coplanar with the other between said upper and lower die means lengthwise of said die means through said stations, a plurality of hands carried in opposed pairs on said conveyors, each of said hands including means for engaging and locating the periphery of a workpiece, said bands being spaced from each other lengthwise of said conveyors by distances corresponding to separation between said stations such that at least one opposed pair of said hands is positioned to engage a workpiece at each said station, means mounting each said hand to the associated conveyor for horizontal motion laterally inwardly of said die means, first means for engaging laterally opposed hands on said conveyors at said load station to cause said hands to engage and locate a workpiece positioned therebetween, said first means comprising means at said load station for moving laterally opposed pairs of said hands laterally inwardly simultaneously to engage lateral edges of a workpiece positioned therebetween, second means for engaging laterally opposed hands on said conveyors at said unload station to cause said hands to release a workpiece positioned therebetween, said second means comprising means at said unload station for moving laterally opposed pairs of hands laterally outwardly simultaneously to release lateral edges of a workpiece positioned therebetween, and means for indexing said conveyors and workpieces engaged and located by said hands lengthwise of said die means through said stations by incremental distances corresponding to separation between said stations, each of said hands including third means affixed to the associated conveyor, fourth means mounted on said third means for motion laterally inwardly of said die means, fifth means carried by said fourth means for vertical motion with respect to said fourth means and with respect to said conveyor toward and away from said lower die means, and a workpiece finger carried by said fifth means for engaging the workpieces, there being means operatively coupled to said upper die means for moving said fourth means and said finger vertically with respect to said conveyor, said fourth and fifth means comprising respective slides.

25. A die transfer system that includes lower die means, upper die means carried for reciprocal movement toward and away from said lower die means to perform at least one operation on a workpiece positioned therebetween, and means for sequentially conveying workpieces between said die means comprising;

a plurality of hands for engaging workpieces and being spaced from each other by distances corresponding to stations of said die means, means for indexing said hands in a direction through said die means between said stations in synchronism with motion of said upper die means, and means for moving said hands simultaneously in at least one direction perpendicular to said indexing direction comprising a camshaft extending through said stations and having an axis parallel to said indexing direction of said upper die means, cam means mounted on said camshaft for rotation therewith, and follower mans coupling said cam means to said hands, said means for rotating said camshaft in synchronism with motion of said upper die means comprising a cam plate depending from said upper die means, a drive arm extending radially from said camshaft, and a crank arm coupling said cam plate to said drive arm for rotating said cam shaft in opposite direction during descent and ascent of said upper die means.

26. The system set forth in claim 25 wherein said cam plate has a cam slot, and wherein said crank arm has first roller means engaged in said slot and second roller means engaged with said drive arm.

27. A die transfer system that includes lower die means, upper die means carried for reciprocal movement toward and away from said lower die means to perform at least one operation of a workpiece positioned therebetween, and means for sequentially conveying workpieces between said die means comprising:

a plurality of hands for engaging workpieces and being spaced from each other by distances corresponding to stations of said die means, means for indexing said hands in a direction through said die means between said stations in synchronism with motion of said upper die means, and means for moving said hands simultaneously in at least one direction perpendicular to said indexing direction comprising a camshaft extending through said stations and having an axis parallel to said indexing direction, means for rotating said camshaft in synchronism with motion of said upper die means, cam means mounted on said camshaft for rotation therewith, and follower mans coupling said cam means to said hands, said means for rotating said camshaft in synchronism with motion of said upper die means comprising a conveyor having said hands mounted thereon, a drive shaft coupled to said conveyor for rotation about an axis perpendicular to said camshaft axis, and means operatively coupled to said drive shaft for rotating said drive shaft in opposite directions during descent and ascent of said upper die means.

28. A die transfer system set forth in claim 27 wherein said means operatively coupled to said drive shaft comprises an electric servo motor.

29. The die transfer system set forth in claim 27 wherein said means for rotating said camshaft comprise an electric servo motor.

30. The die transfer system set forth in claim 27 wherein said means operatively coupled to said drive shaft and said means for rotating said camshaft comprise first and second electric servo motor means respectively operatively coupled to said drive shaft and said camshaft, and means for operating said servo motor means in sequence so that motions of said hands in said indexing direction and perpendicular to said indexing direction take place alternately and not simultaneously.

31. The system set forth in claim 27 wherein said follower means comprises an arm mounted adjacent to said cam means to rotate about an axis parallel to said camshaft axis, and a bar coupled to said arm and extending through said stations parallel to said camshaft axis coupling said arm to said plurality of hands for moving said hands simultaneously as a function of rotation of said arm.

32. The system set forth in claim 27 wherein said means for rotating said drive shaft comprises a drive arm extending radially from said drive shaft, a cam plate depending from said upper die means, and a crank arm coupling said cam plate to said drive arm.

33. The system set forth in claim 17 wherein said cam plate has a cam slot, and wherein said crank arm has first roller means engaged in said slot and second roller means engaged with said drive arm.

34. The system set forth in claim 33 wherein said conveyor comprises an endless loop conveyor having a reach extending between said upper and lower die means, said hands being mounted on said reach.

35. The system set forth in claim 27 wherein said means for rotating said camshaft in synchronism with motion of said upper die means comprises means affixed to said upper die means and operatively coupled to said camshaft for rotating said camshaft in opposite direction during descent and ascent of said upper die means.

36. The system set forth in claim 35 wherein said means affixed to said upper die means comprises first and second cam means, and first and second follower means operatively coupling said first and second cam means to said camshaft and said drive shaft respectively.

37. The system set forth in claim 36 wherein said first and second cam means include respective dwell portions such that at least a portion of rotation of said cam shaft takes place in the absence of rotation at said drive shaft.

38. The system set forth in claim 36 wherein said first and second cam means comprise first and second cam plates respectively, each of said cam plates having a cam slot, and wherein each of said first and second follower means comprises means positioned in the associated said slot.

39. The system set forth in claim 38 wherein each said slot comprises a double track slot and means for guiding said follower means through one track during descent of said upper die means and through the other track during ascent of said upper die means.

40. The system set forth in claim 39 wherein geometry of said first track in said first and second plates is such that said camshaft is rotated by said first follower means in engagement with said first track in said first cam plate while said drive shaft is stationary during initial descent of said upper die means, followed by rotation of said drive shaft by said second follower means and said first track in said second cam plate while said camshaft is stationary during final descent of said upper die means.

41. The system set forth in claim 40 wherein geometry of said second tracks in said first and second plates is such that said camshaft is rotated by said first follower means in engagement with said second track in said first cam plate while said drive shaft is stationary during initial ascent of said upper die means, followed by rotation of said drive shaft by said second follower means and said second track in said second cam plate while said camshaft is stationary during final ascent of said upper die means.

42. A die transfer system that includes lower die means, upper die means carried for reciprocal movement toward and away from said lower die means to perform at least one operation on a workpiece positioned therebetween, and means for sequentially conveying workpieces between said die means comprising:

a plurality of hands for engaging workpieces and being spaced from each other by distances corresponding to stations of said die means, means for indexing said hands in a direction through said die means between said stations in synchronism with motion of said upper die means, means for moving said hands simultaneously in at least one direction perpendicular to said indexing direction comprising a camshaft extending through said stations and having an axis parallel to said indexing direction, means for rotating said camshaft in synchronism with motion of said upper die means, cam means mounted on said camshaft for rotation therewith, and follower means coupling said cam means to said hands, and means for rotating at least one of said hands about an axis perpendicular to said indexing direction.

43. A die transfer system that includes lower die means, upper die means carried for reciprocal movement toward and away from said lower die means to perform at least one operation on a workpiece positioned therebetween, and means for sequentially conveying workpiec .s between said die means comprising:

a plurality of hands for engaging workpieces and being spaced from each other by distances corresponding to stations of said die means, means for indexing said hands in a direction through said die means between said stations in synchronism with motion of said upper die means, and means for moving said hands simultaneously in at least one direction perpendicular to said indexing direction comprising a camshaft extending through said stations and having an axis parallel to said indexing direction, means for rotating said camshaft in synchronism with motion of said upper die means, cam means mounted on said camshaft for rotation therewith, and follower means coupling said cam means to said hands, said means for indexing said hands and said means for rotating said camshaft comprising first and second servo motor means respectively operatively coupled to said hands and said camshaft, and means for operating said servo motor means in sequence so that motions of said hands in said indexing direction and perpendicular to said indexing direction take place alternately and not simultaneously.

* * * * *

UNITED STATES PATENT AND TRADEMARK OFFICE

CERTIFICATE OF CORRECTION

PATENT NO. : 5,136,874

DATED : August 11, 1992

INVENTOR(S) : Alfred C. Fisch

It is certified that error appears in the above-identified patent and that said Letters Patent is hereby corrected as shown below:

In the Drawings:
Replace FIG. 18 of the patent as issued with corrected FIG. 18 as attached.

Signed and Sealed this

Tenth Day of May, 1994

*Attest:*

*Attesting Officer*

BRUCE LEHMAN

*Commissioner of Patents and Trademarks*